United States Patent [19]

Winstein et al.

[11] Patent Number: 5,030,141

[45] Date of Patent: Jul. 9, 1991

[54] KEY CONNECTOR

[75] Inventors: Stan Winstein; Elmer Pratt, both of Los Angeles, Calif.

[73] Assignee: Hughes Aircraft Company, Los Angeles, Calif.

[21] Appl. No.: 545,443

[22] Filed: Jun. 28, 1990

[51] Int. Cl.[5] ..... H01R 13/64

[52] U.S. Cl. ..... 439/680

[58] Field of Search ..... 439/813, 680, 681, 359, 439/362, 364

[56] References Cited

U.S. PATENT DOCUMENTS

| | | | |
|---|---|---|---|
| 3,177,461 | 4/1965 | Hagan et al. | 439/681 |
| 3,714,617 | 1/1973 | Bright et al. | 439/681 |
| 4,277,126 | 7/1981 | Lincoln | 439/681 |
| 4,836,808 | 6/1989 | Mallet et al. | 439/813 |
| 4,929,184 | 5/1990 | Emadi et al. | 439/681 |

FOREIGN PATENT DOCUMENTS

| | | | |
|---|---|---|---|
| 2622363 | 4/1989 | France | 439/680 |

*Primary Examiner*—David L. Pirlot

*Attorney, Agent, or Firm*—Leonard A. Alkov; Wanda K. Denson-Low

[57] ABSTRACT

A connector having a plug housing and a receptacle housing, each having apertured mounting projections on the end walls thereof for mounting the housings to printed circuits and motherboards, respectively, by means of a bolt and nut associated with each projections; and key means including matching planar key tabs and polygonal mounting tabs configured to nestle within a polygonal cutout on the housing projections, these mounting tabs being apertured to receive a mounting bolts so that the keys are secured to the housings and do not protrude beyond the side walls of the housings.

11 Claims, 2 Drawing Sheets

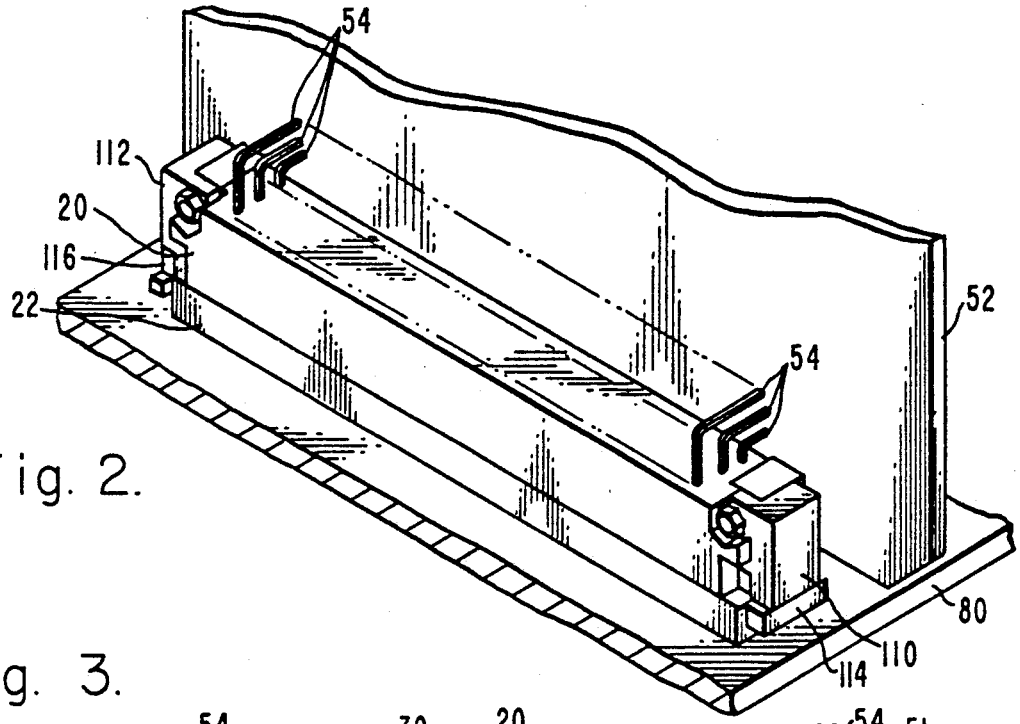
Fig. 2.
Fig. 3.
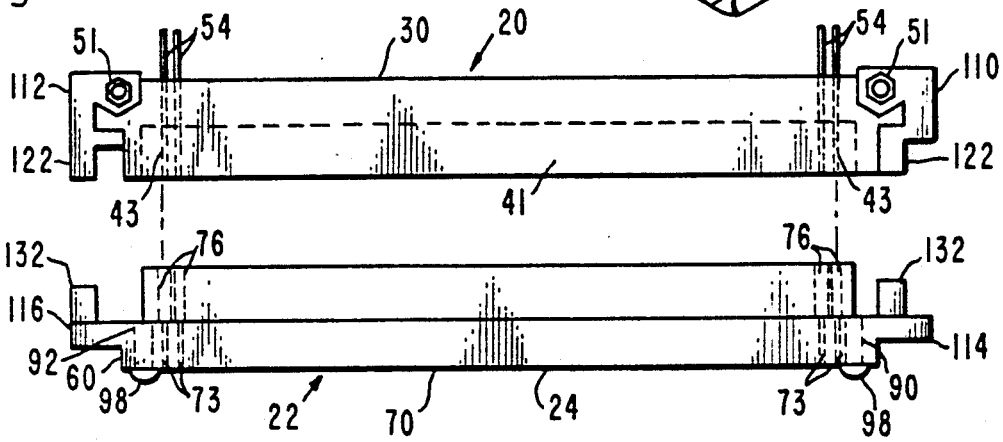
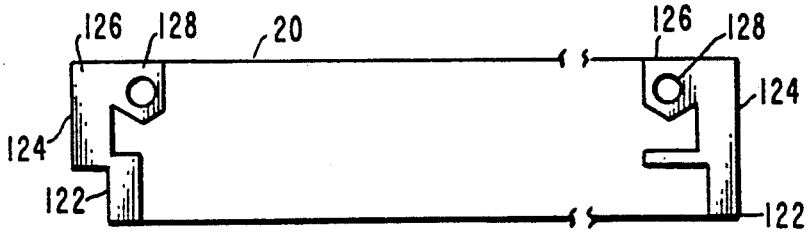
Fig. 4.
Fig. 5a.
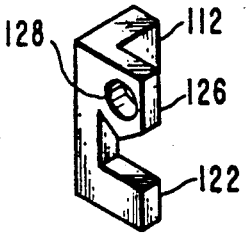
Fig. 5b.
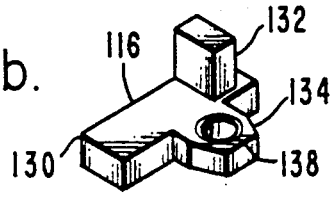

KEY CONNECTOR

BACKGROUND OF THE INVENTION

1. Field of the Invention

This invention relates generally to electrical connectors and more particularly to improved connector key means.

2. Description of the Related Art

In the electronics field there is increasing emphasis on densely packing electronic components which results in constraints being placed on the amount of space electrical connectors takes up, their weight and the reliability in mating the connector parts. Moreover, it is not always possible to observe the match between the connector plug and the connector receptacle located deep within a console. As a result, there is a definite possibility of mechanical damage to the connector or electrical damage to the electronic components if the wrong plug and receptacle are inadvertently mated.

Existing connector keying devices are utilized to prevent this mismatch in which the types of keying means are numerous and varied. Some examples include prongs and sockets, keying tabs and slots, and other such mateable keying members. Some characteristics of these connectors are that they are intrusive and take up valuable space. Moreover, many of them are an integral part of the connector and take up space and add weight even when not required. In addition, some of them are readily damaged if a mismatch occurs. Others have close tolerances and complicated structures which make them costly to manufacture.

SUMMARY OF THE INVENTION

In meeting the challenges mentioned above, the present invention is embodied in an improved keyed connector having a plug which is mateable with a receptacle. A circuit component, such as a printed circuit card, is secured to one of the connector parts, such as the plug by mechanical fasteners, such as nuts and bolts. An array of leads on the plug are soldered to the printed circuit card. The receptacle is in turn fastened to a mother board by nuts and bolts and its leads are soldered to the board. Keys are configured to conform to a connector mounting structure on the ends of the plug and the receptacle whereby the keys are fastened to the plug and receptacle by means of the nuts and bolts which are used to secure the plug and receptacle to the printed circuit card and the mother board and operate as mateable key pairs. Tabs on the key pairs are aligned in registry so that when a mismatch occurs between the plug and the receptacle, the edges of the tabs abut each other and prevent mating of the plug and receptacle. When, however, the correct match is found between a plug and a receptacle, the tab edges do not abut and mating of the plug and receptacle is unimpeded by the keys.

Various advantages of this structure are that the keys have a small size and silhouette so that they are confined generally within the dimensions of a volume defined by the side, top and bottom walls of the plug and the receptacle. Moreover, the keys only extend beyond the end of the plug and the receptacle by about the thickness of the keying tabs. Consequently, the keys do not intrude into the space taken up by the printed circuit board or its guide tracks. Moreover, since they are confined within a volume partially defined by the planes of the sidewalls of the plug and the receptacle, the receptacles can be stacked on the mother board in side-by-side relationship with a minimum of space between each adjacent receptacle. As a result, high density circuit packing is possible. Furthermore, the keys are easily installed on existing connectors and easily detached when not needed. Also, their small size and light weight can eliminate further design and qualification of the structure and circuits. In addition, the keys are not readily damaged by a mismatch in that the load from mismatch insertion forces are transferred to the connector body rather than being fully taken up by the keys. Moreover, the keys are configured so that the adjacent walls of keying tabs on key pairs do not touch each other when a proper match occurs between the receptacle and plug. As a result the keys do not impede the full and normal mating of the connector parts. Moreover, while the key is preferably used with printed circuit cards, it can readily be used with other types of circuits such as, for example, flexible cables and modules.

BRIEF DESCRIPTION OF THE DRAWING

FIG. 2 is a perspective view showing the connector of FIG. 1 with the keys attached thereto in which the plug and receptacle are mated;

FIG. 3 is a side elevation view of a connector in which the plug and receptacle and the keys are not matched;

FIG. 4 is a side elevation showing a second combination of plug keys which would mate with the receptacle keys of FIG. 3; and FIG. 5*a* and 5*b* are perspective views of another combination of keys in which the planes of the alignment tabs are rotated 90° relative to the planes of the alignment tabs of FIGS. 1 through 4.

DESCRIPTION OF THE PREFERRED EMBODIMENTS

Figure 1:
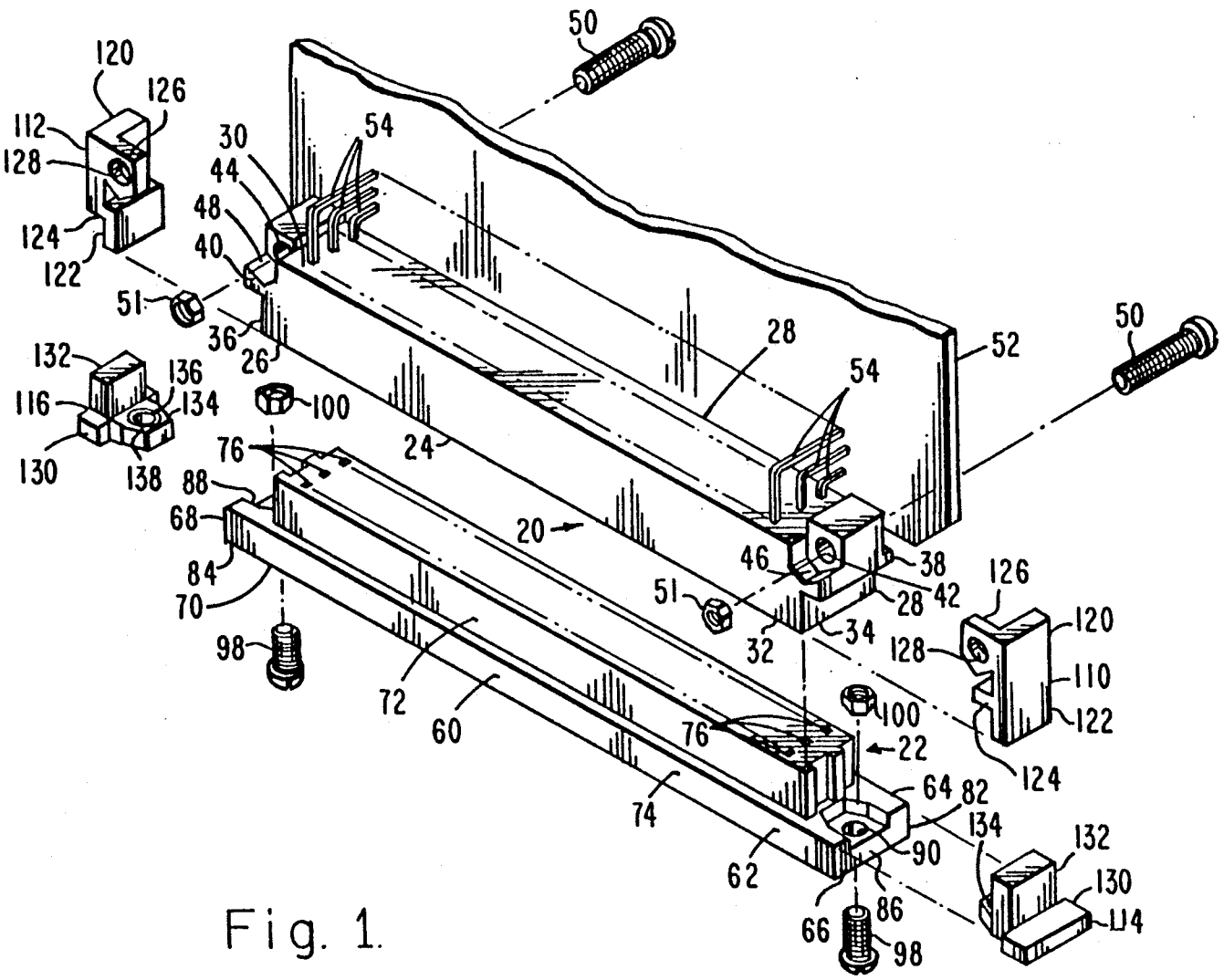
FIG. 1 is a perspective view of a connector showing keys disconnected from a spaced apart plug and receptacle prior to installation thereon.

As illustrated in the perspective view of FIG. 1, a connector comprising a plug 20 and a receptacle 22 are shown in a spaced apart, unmated relationship to one another. The plug 20 includes an elongated generally rectilinear housing 24 having side walls 26 and 28, top wall 30, and a bottom edge 32. Two end walls 34 and 36 each have a mounting projection 38 and 40, respectively thereon. Mounting apertures 42 and 44 extend transversely through the projections 38 and 40 respectively in a direction from side wall 26 to side wall 28. One side of each projection 38 and 40 has a generally polygonal cavity or cutout 46 and 48 respectively formed at one end thereof with the axis of the mounting apertures 42 and 44 extending therethrough.

Bolts 50 are inserted into apertures (not shown) in a printed circuit card 52 and are inserted through the mounting apertures 42 and 44 to fasten the printed circuit card 52 to the plug housing 24. The polygonal cutouts 46 and 48 are configured so that they would normally each receive a hexagonal mounting nut 51 if the keys were not attached to the plug housing 24.

The side walls 26 and 28 and the end walls 34 and 36 define a generally elongate rectilinear cavity 41 (FIG. 3). An array of pins 49 (FIG. 3) are disposed within this cavity in general axial registration with the array of leads 54 extending from the top wall of the housing 24. These leads 54 are soldered to the printed circuit card 52 in electrical communication with circuit elements (not shown) on the card 52.

Similarly, the receptacle 22 includes a housing 60 which is generally elongate and rectilinear in configuration. The receptacle housing 60 includes two generally planar side walls 62 and 64 two generally planar end walls 66 and 68, and a bottom wall 70 which combine to form a base portion 74. A generally rectilinear plug 72 projects up from the base portion 74 of the housing 60. An array of sockets 76 are disposed across the top of the plug 72 in conformity with the array of pins 49 contained within the cavity 41 of the plug housing 24. Each of these sockets 76 includes an electrically conductive contact and lead 73 (FIG. 3) which projects through the housing 60 and extends beyond the bottom wall 70. When the receptacle housing 60 is fastened to a motherboard 80, these pins will be soldered to corresponding electrical contacts on the motherboard 80.

Mounting projections 82 and 84 extend from each of the end walls 66 and 68 and each have a polygonal cutout 86 and 88 formed therein on the upper wall of the projections. Mounting apertures 90 and 92 are formed through the polygonal cutouts 86 and 88 in the projections 82 and 84 with their axes normal to the plane of the bottom wall 70.

When the receptacle 60 is to be fastened to the motherboard 80 without keys, bolts 98 are threadably inserted into the apertures 90 and 92 and hexagonal nuts 100 disposed in the polygonal cutouts 86 and 88. While only one receptacle 60 has been shown above the motherboard 80, it should be understood that a plurality of these receptacles 22 would typically be stacked in side-by-side relationship across the surface of the motherboard 80 for densely packed circuits.

Referring now to the keying means in more detail, each connector has two mating keys, 110 and 112, and 114 and 116. Two of the keys 110 and 112 associated with the plug are configured to fit the contours of the mounting projections 38 and 40, respectively, on the end walls of the plug housing 24. The other two keys 114 and 116 associated with the receptacle 22 are configured to conform to the projections 82 and 84 on the end walls of receptacle housing 60.

Each of the keys 110 and 112 will be either mirror images or very nearly mirror images of one another and include a generally rectilinear support body 120 having a planar generally rectilinear keying tab 122 projecting toward the receptacle 22 in a plane parallel to the plane of the end walls 34 and 36. A generally rectilinear stop member 124 projects laterally from the support body 120 in the direction of the housing 24 in a plane normal to the plane of keying tabs 122. In addition, a mounting tab 126 projects from the surface of the support body in the direction of the housing 24 in a plane normal to the planes of the keying tab 122 and the stop member 124. One surface and edge of the mounting tab 126 has a polygonal configuration which fits the polygonal cutouts 46 and 48. Mounting apertures 128 are formed through each of the mounting tabs 126 and when the keys 110 and 112 are placed on the projections 38 and 40, the mounting apertures 128 are in axial registry with the mounting apertures 42 and 44 in the mounting projections 38 and 40.

To secure the keys 110 and 112 to the plug housing 24, the bolt 50 is inserted through an aperture (not shown) in the printed circuit card 52, the aperture 42 in the projection 38, and the aperture 128 in the key. The nut 51 is then threaded onto the bolt 50 to secure the key 110 to the housing 24. Similarly the key 112 is secured to the other end wall of the plug housing 24 by bolt 50 inserted through an aperture in the printed circuit card 52, an aperture 44 in the mounting projection 40 and the aperture 128 in the mounting tab 126. A nut 51 is threaded onto the bolt 50 to secure the key 112 to the plug 20. To detach the keys 110 and 112 from the plug housing 60 this procedure is reserved.

It should be noted that while the keys 110 and 112 are generally mirror images of each other, except that the keying tabs 122 have been displaced in planes at different lateral distance from to the end wall 34 and 36 of the housing 24, they could in some combinations be mirror images of each other. As will be explained shortly, this lateral displacement of the planes of keying tabs allows for the different keying combinations of key pairs when matching with the corresponding keys 114 and 116 associated with the receptacle housing 60.

It should also be noted that the keys 110 and 112 are configured and dimensioned so that they do not project beyond the planes of the side walls 26 and 28 of the plug housing 24 or the bottom edge 32 of the housing. Moreover, the keys 110 and 112 only add to the length of the connector an amount about equal to the thickness of the keying tabs 122 or the support body 120.

The keys 114 and 116 associated with the receptacle housing 60 will be either mirror images or very nearly mirror images of each other, and each include an alignment tab 130 and a planar keying tab 132 of generally rectilinear configuration projecting in the direction of plug 20 in a plane parallel to the plane of the end walls 66 and 68. Mounting tabs 134 also project from the alignment tabs 130 in a plane normal to the plane of the keying tabs 132 and the end walls. The lateral displacement of the keying tabs 132 from the end walls 66 and 68 is the distinguishing feature between keys 114 and 116 and allows for the different keying combinations for matching with the corresponding key 110 and 112 associated with the plug 20. These mounting tabs have a polygonal configuration and conform to the polygonal cutouts 86 and 88 in the projections 82 and 84 of the receptacle housing 60.

Mounting apertures 136 are formed through the mounting tabs 134 and are located so that when the alignment tabs 130 of keys 114 and 116 are positioned to embrace the projections 82 and 84 on the housing 60, the axes of the mounting apertures 136 in the keys 112 and 116 are in alignment with the mounting apertures 90 and 92 in the mounting projections. A threaded insert 188 of durable metal is fixedly secured within the mounting aperture 136.

To connect the receptacle 22 to the motherboard 80, the bolts 98 are inserted through apertures in the motherboard 80 through the apertures 90 and 92 in the housing 60 and are threaded onto the inserts 138 thereby securely fastening the keys 114 and 116 to the housing 60 without the use of nuts 100. To detach the keys 114 and 116 this procedure is reversed.

As previously stated, while the keys 114 and 116 are generally similar, the planes of the keying the tabs 130 are displaced relative to the planes of the end walls 66 and 68 of the housing 60. The plug key 110 and receptacle key 114 should be considered a first key pair and the plug key 112 and receptacle key 116 should be considered a second key pair. Consequently if, as illustrated in FIG. 2, the keying tabs on the mating key pairs 110 and 114 and/or key pair 112 and 116 are not in planar registration with one another, they will allow the plug 20 and receptacle 22 to mate so that the plug 72 nests within the cavity 42 and the prongs and sockets are mated and make electrical contact between the printed circuit card 52 and the motherboard 80.

It should also be noted that the keys 114 and 116 are dimensioned and configured so that they do not protrude beyond the planes of the side walls 62 and 64 and the bottom wall 70 of the receptacle housing 60 and preferably do not project beyond the top surface of the plug projection 72.

When a proper mating occurs between the plug 20 and receptacle 22 as illustrated in FIG. 2, the key pairs 110 and 114 and 112 and 116 do not interfere with or otherwise impede the mating of the plug and receptacle 20 and 22. This occurs because the keying tabs 122 and 132 on each of the keys are dimensioned and their planes registered so that adjacent side walls of the keying tabs 122 and 132 of each key pair are spaced apart during the mating of the plugs and do not touch, until the connector parts are fully inserted whereupon only the top edges of the keying tabs 132 abut the stop members 124. Thus mating of the plug 20 and receptacle is unimpeded by the keys. If, however, there is a mismatch between the keying tabs 122 and 132 as illustrated in FIG. 3, the planes of keys will be in planar registry and alignment with one another and their edges will abut one another to prevent mating of the plug 20 and receptacle 22.

As illustrated in FIGS. 4 and 5, various combinations of the keys pairs can be configured by repositioning the keying tabs 122 and 132 relative to the positions illustrated in FIGS. 1 through 3. For example, in FIG. 4, the planes of the keying tabs have been repositioned laterally, relative to the planes of the end walls of the housings 24 and 60. As illustrated in FIG. 5, the planes of the keying tabs 122 and 132 have been rotated by 90 degrees relative to the planes of the key tabs 122 and 132 in the preceding embodiments. This rotation thus gives another plurality of combinations for the key pairs.

It is possible to make the keys 110 through 116 out of a variety of rigid materials, including for example aluminum. However, it has been found that they can be made by injection molding of carbon-filled nylon such as, graphite-impregnated fibers. The use of this wide variety of materials is possible because the forces associated with the insertion of the receptacle and plug which would incur because of a mismatch between the keying tabs 122 and 132 would be transferred along the keying tab 122 and 132 member 124 to the housings 24 and 60 through the end-wall projections 38 and 40, and 82 and 84. This enables the dimensioning of the keys 110 through 116 to be kept very small.

While salient features have been described with respect to particular embodiments, many variations and modifications can be made without departing from the scope of the invention. Accordingly, that scope is intended to be limited only by the scope of the appended claims.

What is claimed is:

1. An electrical connector assembly comprising:

an elongate first connector portion having first and second sidewalls, a top wall and first and second end walls, each having connector-securing projections extending from said end walls, said projections being apertured to receive a mounting bolt with a cutout at respective ends of said aperture for receiving a mounting nut;

a second connector portion operable to mate with said first connector portion and having first and second walls, a bottom wall, and first and second end walls each having a connector-mounting projection extending from said end walls, said projections being apertured to receive a mounting bolt and having a cutout for receiving a nut at one end of said aperture;

first electrical contact means disbursed in said first connector portion;

second electrical contact means disbursed in said second connector portion and being operable to mate with said first electrical contact means when said first connector portion is mated with said second connector portion; and detachable pairs of key means being configured to match the surface contour of said mounting projections and each being apertured to receive the mounting bolt to fasten said key means to said projections, each of said pairs of detachable keys having a planar keying tab which is registered to operably pass by the other key tab of said pair when a match occurs and to contact each other and prevent mating of said first and second connector portions with a mismatch occurs between a pair of key means and wherein said key means each include a mounting tab which is configured to fit within said nut mounting cutout and said mounting tab is apertured in axial alignment with the aperture in said projection when said mounting tab is nested in said nut-receiving cutout.

2. The electrical connector assembly of claim 1 in which said keying tabs are substantially rectilinear.

3. The electrical connector assembly of claim 1 in which said keying tabs are disposed in planes which are substantially parallel to the planes of said end walls of said first and said second connector portions.

4. The electrical connector assembly of claim 1 in which said keying tabs are oriented in planes which are at a right angle to the planes of said end walls of said first and second connector portions.

5. The electrical connector assembly of claim 1 in which said mounting tab is configured in a polygon, conforming to the polygonal configuration of the mounting nut.

6. The electrical connector assembly of claim 1 in which the aperture of one of said pairs of said key means include a threaded insert.

7. The electrical connector assembly of claim 1 in which each one of said key means of said pairs of key means when attached to the projections is disposed in a space defined generally by the planes of side walls, said top walls and said bottom walls of said first connector portion and said second connector portion.

8. The electrical connector assembly of claim 1 in which said nut receiving cutout is polygonal.

9. The electrical connector assembly of claim 8 in which said nut receiving cutout is polygonal to receive to hexagonal nut.

10. The electrical connector assembly of claim 1 in which one of said key means each of said pairs of key means has a stop member which is operable to contact the surface of said projection and the other of said key means of each of said pair of key means includes an alignment tab operable to contact the surface of projection on the other of said first and second connector portions.

11. The connector assembly of claim 10 in which the adjacent side walls of said keying tabs of said key pairs operable pass by each other without contact when a match occurs between that key pair.

* * * * *